United States Patent [19]

Ikushima et al.

[11] Patent Number: 4,692,192

[45] Date of Patent: Sep. 8, 1987

[54] ELECTROCONDUCTIVE SPRING MATERIAL

[75] Inventors: Kazuo Ikushima, Nagoya; Takaharu Iwadachi; Syuhei Ishikawa, both of Handa, all of Japan

[73] Assignee: NGK Insulators, Ltd., Japan

[21] Appl. No.: 776,454

[22] Filed: Sep. 16, 1985

[30] Foreign Application Priority Data

Oct. 30, 1984 [JP] Japan ..... 59-228499
Jan. 22, 1985 [JP] Japan ..... 60-10620
Jan. 22, 1985 [JP] Japan ..... 60-10621

[51] Int. Cl.[4] ..... C22C 9/06; C22F 1/08
[52] U.S. Cl. ..... 148/12.7 C; 148/414
[58] Field of Search ..... 420/485, 469, 494, 470, 420/471, 479; 148/12.7 C, 414

[56] References Cited

U.S. PATENT DOCUMENTS 1,893,984 1/1933 Corson ..... 420/485
2,136,212 11/1938 Heusel et al. ..... 420/485

FOREIGN PATENT DOCUMENTS 163248 12/1981 Japan ..... 148/414
59-145749 8/1984 Japan .
62-15622 4/1987 Japan .
532133 1/1941 United Kingdom ..... 420/485

*Primary Examiner*—Melvyn J. Andrews
*Assistant Examiner*—George Wyszomierski
*Attorney, Agent, or Firm*—Parkhurst & Oliff

[57] ABSTRACT

A low cost electroconductive spring material excellent in electroconductivity and spring performance, has from 1.8 to 3.0% by weight of Ni, from 0.15 to 0.35% by weight of Be, from 0.2 to 1.2% by weight of Si and the balance being copper. This low cost electroconductive spring material can be used in electric devices. As preferred embodiments, the electroconductive spring material may further contain from 0.05 to 3.0% by weight in a total amount of at least one component selected from Sn, Al and Zn provided that each of Sn, Al and Zn does not exceed 1.5% by weight, or from 0.01 to 1.5% by weight in a total amount of at least one component selected from Co, Fe, Zr, Ti and Mg, provided that each of Co, Fe, Zr, Ti and Mg does not exceed 1.0% by weight. Moreover, the electroconductive spring material is subjected to a final solidification heat treatment at a temperature of 880°-950° C., a cold processing of not greater than 80%, and an aging treatment at a temperature of 380°-530° C. for not more than 2 hours.

15 Claims, No Drawings

ELECTROCONDUCTIVE SPRING MATERIAL

BACKGROUND OF THE INVENTION (1) Field of the Invention

The present invention relates to a low cost electroconductive spring material excellent in electroconductivity and spring performance, which is used as a material for electric devices such as a connector, a switch, a relay and the like.

(2) Related Art Statement

As the electroconductive spring materials having excellent electroconductivity and spring performance, there are typically specified as C-5191 or C-5212 in JIS (Japanese Industrial Standard), H3110 and C-5210 in JIS H3130 for instance phosphor bronze containing from 5.5 to 9.0% by weight (hereinafter referred to briefly as "%" throughout the specification) of Sn and from 0.03 to 0.35% of P. Since the electroconductivity, bending formability, stress relaxation property and the like are insufficient when such phosphor bronze is used in miniaturized electronic parts, with the high reliability required, there has been increasing demand for improvements thereof. On the other hand, as one of the electroconductive spring materials meeting such demand, there is an alloy with a nominal composition of 0.4% of Be, 1.8% of Ni and the balance being Cu (Cu-0.4% Be-1.8% Ni). However, the material cost is unfavorably high because of a high price of Be (For instance, Japanese Patent Application Laid-open No. 14,612/1978).

The present invention has been accomplished to solve the problems encountered by the prior art alloys.

SUMMARY OF THE INVENTION

It is therefore an object of the present invention to provide an electroconductive spring material which is excellent in cost performance with the percentage of expensive Be being reduced while excellent properties of the conventional Cu-0.4% Be-1.8% Ni alloy being maintained.

According to a first aspect of the invention, there is a provision of an electroconductive spring material comprising from 1.8 to 3.0% of Ni, from 0.15 to 0.35% of Be, from 0.2 to 1.2% of Si and the balance being Cu, and preferably from 2.0 to 2.8% of Ni, from 0.20 to 0.25% of Be, from 0.3 to 1.0% of Si, and the balance being Cu.

According to a second aspect of the invention, there is a provision of an electroconductive spring material comprising from 1.8 to 3.0% of Ni, from 0.15 to 0.35% of Be, from 0.2 to 1.2% of Si, from 0.05 to 3.0% in a total amount of at least one component selected from the group consisting of Sn, Al and Zn provided that each of Sn, Al and Zn is from 0.05 to 1.5%, and the balance being Cu with inevitable impurities.

According to a third aspect of the invention, there is a provision of an electroconductive spring material which comprises from 1.8 to 3.0% of Ni, from 0.15 to 0.35% of Be, from 0.2 to 1.2% of Si, from 0.01 to 2.0% in a total amount of at least one component selected from the group consisting of Co, Fe, Zr, Ti and Mg provided that each of Co, Fe, Zr, Ti and Mg is from 0.01 to 1.0%, and the balance being Cu with inevitable impurities.

These and other objects, features and advantages of the invention will be well appreciated upon reading the following description of the invention with understanding that some modifications, variations and changes of the invention could be easily done by those skilled in the art to which the invention pertains without departing from the spirit of the invention or the scope of claims appended hereto.

DETAILED DESCRIPTION OF THE INVENTION

The first aspect of the present invention has been accomplished based on a novel acknowledgement that the crystal grain-growth during solution treatment, which becomes a problem when the Be amount is decreased while the reduction in strength due to the decrease of the Be amount for lowering the cost is complemented by the increase of Ni and addition of Si, can be effectively suppressed by setting Ni at from 1.8 to 3.0%. According to the first aspect of the invention, the low cost electroconductive spring material which has equal or more excellent strength and spring performance as compared with the conventional phosphor bronze, has an excellent mechanical strength, bending formability, stress relaxation properties and electroconductivity.

The second aspect of the invention, has been accomplished based on a novel acknowledgement that in addition to the effects produced by the increase of Ni and the addition of Si, the stress relaxation property can be enhanced through addition of Si in a range of from 0.2 to 1.2%, and the addition of at least one component selected from Sn, Al and Zn is useful for further increasing the material strength.

The third aspect of the present invention has been accomplished based on a novel acknowledgement that in addition to the effects produced by the increase of Ni and the addition of Si, the further addition of at least one component selected from Co, Fe, Zr, Ti, and Mg is useful for making finer the crystalline grain and additionally increasing the material strength.

Next, reasons for restriction on the contents of the alloy components in the electroconductive spring material according to the present invention will be explained below.

If Ni is less than 1.8%, it is impossible to prevent the coarsing of the crystal grain during the solution treatment due to the decrease in Be amount, so that the mechanical strength, elongation and formability can not be enhanced, while if it exceeds 3.0%, the improvement on the properties corresponding to the increase in the addition amount can not be obtained and the rolling processability and the bending formability are moreover deteriorated. Thus, Ni is restricted to a range of from 1.8 to 3.0%, particularly an optimum range being from 2.0 to 2.8%.

If Be is less than 0.15%, the precipitation hardenability becomes smaller and the coarsening of the crystal grains during the solution treatment can not be prevented, while it exceeds 0.35%, the effect of reducing the cost of the materials becomes smaller. Thus, Be is restricted to a range of from 0.15 to 0.35%, particularly, an optimum range being from 0.2 to 0.25%.

Si is an important component to complement the reduction in strength due to the decrease of the Be amount and improve the elongation, formability and the stress relaxation property. If Si is less than 0.2%, its effects are not remarkable, while if it exceeds 1.2%, the conductivity is conspicuously damaged. Thus, Si is restricted to a range of from 0.2 to 1.2%, particularly, a preferred range being from 0.3 to 1.0%. The addition of Si in a range of from 0.2 to 1.2% leads to large improvement on the castability, the slag separability and oxidation resistance of the alloy as well as the reduction in the manufacturing cost.

When added to the above alloy components in an amount of 0.05 to 1.5%, each of Sn, Al, and Zn contributes to the enhancement of the mechanical strength of the alloy. If each of these components is less than 0.05%, no substantial effect can be observed, while inversely if any one of them exceeds 1.5% or the total amount thereof exceeds 3.0%, the effect is saturated, the elongation and formability are deteriorated and the material cost increases.

Co, Fe, Zr, Ti, and Mg are components which contribute to making finer the crystal grains of the alloy and the improvement of the mechanical strength thereof, when added in a range of from 0.01 to 1.0% into the above alloy components. If each of these components is less than 0.01%, no substantial effect can be observed, while inversely if any one of them exceeds 1.0% or the total amount of at least one component selected from them exceeds 2.0%, the effects are saturated, which is disadvantageous in terms of the material cost and deteriorates the elongation and the formability.

The alloy according to the present invention may be produced by an ordinary atmospheric melting, and may be cast by using an arbitrary casting system. A cast ingot is subjected to hot forging and hot rolling to obtain an intermediate material, which is repeatedly subjected to cold rolling and annealing. Then, the resulting cold rolled sheet undergoes solution treatment at from 880° to 950° C. and cold processing from 0 to 80%, followed by aging treatment. Ordinarily, the aging treatment is preferred to be performed at from 380° to 530° C. Upon necessity, hot forging and hot rolling may be omitted.

The present invention will be described more in detail by referring to specific Examples together with Comparative Examples, but these Examples are merely illustrative of the invention and should not be interpreted to limit the scope thereof.

cold rolling after being annealed at 800° C. to obtain a sheet of 0.32 mm in thickness.

Next, the cold rolled sheet was heated at 900° C. for 5 minutes and then quenched in water as a final solution treatment, and further rolled at a reduction ratio of 37%. Thereafter, aging treatment was performed at 400° C. for 2 hours, and the properties of the product were measured. Comparative Example 4 is a conventional phosphor bronze SH material used for the spring. The properties thereof were evaluated with respect to 0.2 mm in thickness of a commercially available phosphor bronze SH material for the spring. Results are shown in Table 2.

In Tables 2, 4 and 6, the stress relaxation property was evaluated based on a stress residual percentage by applying a maximum bending stress (load) of 40 kgf/mm$^2$ upon a test piece, releasing the load from the test piece after maintaining it at 200° C. for 100 hours, and measuring a residual stress. The bending formability was evaluated by the ratio of the minimum bending radius R which did not cause cracks to the thickness t. The values at 0° are values specific to the rolling direction, while those at 90° are values specific to at 90° to the rolling direction.

TABLE 1

| | Alloy components (weight %) | | | |
|---|---|---|---|---|
| | Ni | Be | Si | Cu |
| Example | | | | |
| 1 | 2.9 | 0.15 | 0.3 | balance |
| 2 | 2.5 | 0.21 | 0.6 | " |
| 3 | 2.6 | 0.22 | 0.9 | " |
| 4 | 3.0 | 0.28 | 0.2 | " |
| 5 | 1.9 | 0.25 | 0.3 | " |
| Comparative Example | | | | |
| 1 | 1.7 | 0.24 | 0.3 | " |
| 2 | 1.6 | 0.28 | 0.8 | " |
| 3 | 1.8 | 0.40 | — | " |
| 4 | Sn 8.5%, P 0.26% | | | " |

TABLE 2

| | Properties | | | | | | | | | | |
|---|---|---|---|---|---|---|---|---|---|---|---|
| | Stress relaxation property | Conductivity IACS | Crystal grain size | Elongation % | | Young's modulus kgf/mm$^2$ | | Tensile strength kgf/mm$^2$ | | Bending formability R/t | |
| | % | % | μm | 0° | 90° | 0° | 90° | 0° | 90° | 0° | 90° |
| Example | | | | | | | | | | | |
| 1 | 84 | 35 | 20 | 8 | 6 | 13,500 | 14,000 | 75 | 76 | 3 | 2 |
| 2 | 90 | 34 | 14 | 7 | 11 | 13,600 | 14,200 | 82 | 82 | 2 | 2 |
| 3 | 95 | 26 | 16 | 9 | 13 | 13,800 | 14,000 | 85 | 85 | 2 | 2 |
| 4 | 86 | 36 | 11 | 9 | 9 | 14,000 | 14,500 | 87 | 93 | 2 | 3 |
| 5 | 84 | 45 | 13 | 8 | 10 | 13,400 | 13,800 | 87 | 86 | 1 | 2 |
| Comparative Example | | | | | | | | | | | |
| 1 | 78 | 44 | 35 | 8 | 9 | 12,000 | 12,800 | 75 | 74 | 4 | 4 |
| 2 | 80 | 23 | 40 | 8 | 10 | 12,100 | 12,600 | 76 | 74 | 5 | 4 |
| 3 | 82 | 57 | 15 | 15 | 18 | 14,000 | 14,000 | 90 | 90 | 2 | 2 |
| 4 | 20 | 10 | 13 | 11 | 13 | 10,100 | 11,000 | 79 | 84 | 1 | 7 |

EXAMPLES 1-5 AND COMPARATIVE EXAMPLES 1-4

Alloy components of each of Examples 1-5 and Comparative Example 1-3 shown in Table 1 were melted in a high frequency induction furnace and cast, and then hot forged and hot rolled in a preheating temperature of 800° C. to obtain a sheet of about 3 mm in thickness. Then, the resulting sheet was repeatedly subjected to

EXAMPLES 6-10 AND COMPARATIVE EXAMPLES 5-10

Alloy components of each of Examples 6-10 and Comparative Examples 5-9 were melted in a high frequency wave induction furnace and cast, and were subjected to hot forging and hot rolling at a heating temperature of 800° C. to obtain a hot rolled sheet of about 3 mm in thickness. Then, the hot rolled sheet was repeatedly subjected to cold rolling after being annealed at 800° C. to obtain a cold rolled sheet of 0.32 mm. Next, the resulting sheet was subjected to heating at 900° C. for 5 minutes and then quenched in water as a final solution treatment, followed by rolling at a reduction ratio of 37%. Thereafter, aging treatment was carried out at 400° C. for 2 hours, and then properties were measured. Comparative Example 10 is a conventional phosphor bronze SH material for spring. Properties of 0.2 mm thickness of a commercially available product were evaluated. Results are shown in Table 4.

TABLE 3

| | Alloy cmponents (% by weight) | | | | | | | |
|---|---|---|---|---|---|---|---|---|
| | Ni | Be | Si | Cu | Sn | Al | Zn | P |
| Example | | | | | | | | |
| 6 | 2.8 | 0.16 | 0.7 | balance | 0.5 | | | |
| 7 | 2.5 | 0.21 | 0.6 | " | | 0.8 | | |
| 8 | 2.6 | 0.22 | 0.9 | " | | | 0.2 | |
| 9 | 2.6 | 0.23 | 0.5 | " | 0.3 | 0.2 | | |
| 10 | 2.5 | 0.24 | 0.4 | " | 0.2 | | 0.4 | |
| Comparative Example | | | | | | | | |
| 5 | 2.6 | 0.23 | 0.6 | " | | | | |
| 6 | 2.5 | 0.23 | 0.5 | " | 3.5 | | | |
| 7 | 2.6 | 0.21 | 0.4 | " | 0.4 | 2.5 | | |
| 8 | 2.3 | 0.20 | 0.6 | " | | 2.6 | 1.3 | |
| 9 | 2.5 | 0.23 | — | " | | | | |
| 10 | — | — | — | " | 8.5 | | | 0.26 |

TABLE 4

| | Properties | | | | | | | | | | |
|---|---|---|---|---|---|---|---|---|---|---|---|
| | Stress relaxation property | Conductivity IACS | Crystal grain size | Elongation % | | Young's modulus kgf/mm² | | Tensile strength kgf/mm² | | Bending formability R/t | |
| | % | % | μm | 0° | 90° | 0° | 90° | 0° | 90° | 0° | 90° |
| Example | | | | | | | | | | | |
| 6 | 86 | 21 | 20 | 11 | 17 | 14,000 | 14,000 | 92 | 95 | 3 | 3 |
| 7 | 87 | 18 | 18 | 8 | 13 | 14,000 | 14,000 | 93 | 97 | 4 | 4 |
| 8 | 87 | 23 | 17 | 8 | 13 | 14,000 | 14,000 | 92 | 94 | 3 | 2 |
| 9 | 89 | 20 | 16 | 8 | 14 | 14,000 | 14,000 | 95 | 95 | 3 | 2 |
| 10 | 86 | 33 | 16 | 10 | 12 | 14,000 | 14,000 | 96 | 97 | 2 | 3 |
| Comparative Example | | | | | | | | | | | |
| 5 | 90 | 34 | 16 | 10 | 16 | 14,000 | 14,000 | 90 | 92 | 2 | 2 |
| 6 | 86 | 16 | 29 | 2 | 4 | 13,500 | 13,000 | 90 | 92 | 5 | 7 |
| 7 | 84 | 14 | 26 | 2 | 3 | 13,500 | 13,500 | 86 | 88 | 6 | 8 |
| 8 | 86 | 18 | 21 | 3 | 4 | 13,500 | 14,000 | 88 | 89 | 6 | 9 |
| 9 | 78 | 59 | 15 | 5 | 7 | 12,000 | 12,500 | 76 | 78 | 4 | 5 |
| 10 | 20 | 10 | 13 | 11 | 13 | 10,100 | 11,000 | 79 | 84 | 1 | 7 |

EXAMPLES 11-19 AND COMPARATIVE EXAMPLES 11-13

Alloy components of each of Examples 11-19 and Comparative Examples 11-13 shown in Table 5 were melted in a high frequency wave induction furnace and cast, and subjected to hot forging and hot rolling at a heating temperature of 800° C. to obtain a sheet of about 3 mm in thickness. The hot rolled sheet was then repeatedly subjected to cold rolling after being annealed at 800° C. to obtain a sheet of 0.32 mm in thickness. Next, the resulting cold rolled sheet was heated at 900° C. for 5 minutes and quenched in water as a final solution treatment. Then, after rolling at a reduction ratio of 37%, aging treatment was performed at 400° C. for 2 hours. Thereafter, the properties of the resulting sheet were measured, with the results being shown in Table 6.

TABLE 5

| | Alloy components (weight %) | | | | |
|---|---|---|---|---|---|
| | Ni | Be | Si | Auxiliary component | Cu |
| Example | | | | | |
| 11 | 2.9 | 0.15 | 0.5 | Co:0.2 | balance |
| 12 | 2.5 | 0.21 | 0.6 | Fe:0.5 | " |
| 13 | 2.6 | 0.22 | 0.9 | Zr:0.3 | " |
| 14 | 3.0 | 0.28 | 0.4 | Ti:0.5 | " |
| 15 | 1.9 | 0.25 | 0.5 | Mg:0.1 | " |
| 16 | 2.5 | 0.23 | 0.6 | Fe:0.5 Ti:0 4 | " |
| 17 | 2.6 | 0.22 | 0.4 | Co:0.2 Fe:0.6 | " |
| 18 | 2.7 | 0.21 | 0.7 | Zr:0.3 Mg:0.2 | " |
| 19 | 2.4 | 0.24 | 0.4 | Ti:0.1 Mg:0.1 | " |
| Comparative Example | | | | | |
| 11 | 2.5 | 0.21 | 0.4 | Co:1.5 | " |
| 12 | 2.6 | 0.23 | 0.6 | Fe:1.2 Ti:0.5 | " |
| 13 | 2.4 | 0.24 | 0.3 | Co:0.5 Fe:1.2 | " |

TABLE 6

| | Properties | | | | | | | | | | |
|---|---|---|---|---|---|---|---|---|---|---|---|
| | Stress relaxation property | Conductivity IACS | Crystal grain size | Elongation % | | Young's modulus kgf/mm² | | Tensile strength kgf/mm² | | Bending formability R/t | |
| | % | % | μm | 0° | 90° | 0° | 90° | 0° | 90° | 0° | 90° |
| Example | | | | | | | | | | | |
| 11 | 90 | 35 | 14 | 8 | 6 | 1.50 | 1.50 | 80 | 82 | 3 | 2 |
| 12 | 95 | 30 | 12 | 10 | 15 | 1.40 | 1.40 | 92 | 94 | 2 | 2 |
| 13 | 92 | 26 | 10 | 9 | 16 | 1.40 | 1.40 | 94 | 96 | 2 | 2 |
| 14 | 90 | 31 | 12 | 11 | 15 | 1.50 | 1.50 | 86 | 86 | 2 | 2 |
| 15 | 83 | 43 | 12 | 10 | 14 | 1.35 | 1.35 | 80 | 83 | 2 | 2 |
| 16 | 93 | 23 | 10 | 9 | 15 | 1.40 | 1.40 | 90 | 94 | 2 | 2 |
| 17 | 92 | 23 | 10 | 9 | 14 | 1.35 | 1.40 | 88 | 92 | 3 | 2 |
| 18 | 93 | 28 | 14 | 11 | 15 | 1.45 | 1.45 | 92 | 96 | 2 | 2 |

TABLE 6-continued

| | Properties | | | | | | | | | | |
|---|---|---|---|---|---|---|---|---|---|---|---|
| | Stress relaxation property | Conductivity IACS | Crystal grain size | Elongation % | | Young's modulus kgf/mm² | | Tensile strength kgf/mm² | | Bending formability R/t | |
| | % | % | μm | 0° | 90° | 0° | 90° | 0° | 90° | 0° | 90° |
| 19 | 88 | 33 | 15 | 9 | 13 | 1.35 | 1.35 | 88 | 90 | 2 | 2 |
| Comparative Example | | | | | | | | | | | |
| 11 | 90 | 20 | 15 | 5 | 8 | 1.35 | 1.40 | 90 | 92 | 4 | 5 |
| 12 | 92 | 21 | 13 | 3 | 6 | 1.35 | 1.35 | 89 | 90 | 5 | 6 |
| 13 | 89 | 28 | 12 | 4 | 4 | 1.30 | 1.30 | 83 | 86 | 6 | 6 |

EFFECTS OF THE INVENTION

As obvious from the foregoing explanation in the Examples, according to the present invention, the content of the expensive component Be is largely reduced as compared with the conventional Cu-0.4% Be-1.8% Ni alloy shown as Comparative Example 3, so that the material cost is reduced, and excellent mechanical strength and stress relaxation properties are maintained simultaneously. Further, as compared with the properties of the conventional phosphor bronze for spring use shown as Comparative Example 4, the formability, particularly in a 90° direction, a transverse direction to the rolling direction, has excellent characteristic values with respect to the Young's modulus, and an excellent stress relaxation property can be successfully obtained. Therefore, the present invention largely contributes to industry, since it results in an alloy which is excellent in cost performance and solves the problems possessed by the conventional electroconductive spring materials.

What is claimed is:

1. An electroconductive spring material comprising 1.8 to 3.0% by weight of Ni, 0.15 to 0.35% by weight of Be, 0.2 to 1.2% by weight of Si and a remainder of the spring material being copper, said spring material having a stress relaxation of at least 84%, a tensile strength of at least 75 kgf/mm² and a bending formability of 1–3 R/t.

2. The electroconductive spring material of claim 1, wherein the amount of Ni is 2.0 to 2.8% by weight, the amount of Be is 0.20 to 0.25% by weight, and the amount of Si is 0.3 to 1.0% by weight.

3. The electroconductive spring material of claim 1, wherein the material further comprises at least one component selected from the group of components consisting of Sn, Al and Zn, and the weight percent of any components selected falls within a range of 0.05 to 3.0% and further, any one component selected does not exceed 1.5% by weight.

4. The electroconductive spring material of claim 1, wherein the material further comprises at least one component selected from the group of components consisting of Co, Fe, Zr, Ti and Mg, and the weight percent of any components selected fall within a range of 0.01 to 2.0% and further, say one component selected does not exceed 1.0% by weight.

5. An electroconductive spring material consisting essentially of 1.8 to 3.0% by weight of Ni, 0.15 to 0.35% by weight of Be, 0.2 to 1.2% by weight of Si and a remainder of the spring material being copper, said spring material having a stress relaxation of at least 84%, a tensile strength of at least 75 kgf/mm² and a bending formability of 1–3 R/t.

6. The electroconductive spring material of claim 5, wherein the amount of Ni is 2.0 to 2.8% by weight, the amount of Be is 0.20 to 0.25% by weight, and the amount of Si is 0.3 to 1.0% by weight.

7. An electroconductive spring material consisting essentially of 1.8 to 3.0% by weight of Ni, 0.15 to 0.35% by weight of Be, 0.2 to 1.2% of Si, a component selected from the group of components consisting of Sn, Al and Zn, and the weight percent of any components selected falls within a range of 0.05 to 3.0% and further, any one component selected does not exceed 1.5% by weight, and a balance of the spring material being copper, said spring material having a stress relaxation of at least 86%, a tensile strength of at least 92 kgf/mm² and a bending formability of 2–4 R/t.

8. The electroconductive spring material of claim 7, wherein the amount of Ni is 2.0 to 2.8% by weight, the amount of Be is 0.20 to 0.25% by weight, and the amount of Si is 0.3 to 1.0% by weight.

9. An electroconductive spring material consisting essentially of 1.8 to 3.0% by weight of Ni, 0.15 to 0.35% by weight of Be, 0.2 to 1.2% of Si, a component selected from the group of components consisting of Co, Fe, Zr, Ti and Mg, and the weight percent of any component selected falls within a range of 0.01 to 2.0% and further, any one component selected does not exceed 1.0% by weight, and a balance of the spring material being copper, said spring material having a stress relaxation of at least 83%, a tensile strength of at least 80 kgf/mm² and a bending formability of 2–3 R/t.

10. The electroconductive spring material of claim 9, wherein the amount of Ni is 2.0 to 2.8% by weight, the amount of Be is 0.20 to 0.25% by weight, and the amount of Si is 0.3 to 1.0% by weight.

11. An electroconductive spring material comprising 1.8 to 3.0% by weight of Ni, 0.15 to 0.35% by weight of Be, 0.2 to 1.2% by weight of Si and a remainder of the spring material being copper, said spring material having been subjected to a final solution treatment at a temperature of 880°–950° C., a cold processing of not greater than 80% and aging at a temperature of 380°–530° C. for two hours or less.

12. The electroconductive spring material of claim 11, wherein the amount of Ni is 2.0 to 2.8% by weight, the amount of Be is 0.20 to 0.25% by weight, and the amount of Si is 0.3 to 1.0% by weight.

13. The electroconductive spring material of claim 11, wherein the material further comprises at least one component selected from the group of components consisting of Sn, Al and Zn, and the weight percent of any components selected falls within a range of 0.05 to 3.0% and further, any one component selected does not exceed 1.5% by weight.

14. The electroconductive spring material of claim 11, wherein the material further comprises at least one component selected from the group of components consisting of Co, Fe, Zr, Ti and Mg, and the weight percents of any components selected fall within a range of 0.01 to 2.0% and further, any one component selected does not exceed 1.0% by weight.

15. A method of producing an electroconductive spring material comprising:

preparing an alloy comprising 1.8 to 3.0% by weight of Ni, 0.15 to 0.35% by weight of Be and 0.2 to 1.2% by weight of Si, and a remainder of the spring material being copper;

final solution treating the prepared alloy at a temperature of 880°–950° C.;

cold processing the solution treated alloy to not greater than 80%; and aging the cold processed alloy at a temperature of 380°–530° C. for a period of not greater than two hours.

* * * * *